US010030604B2

(12) United States Patent
Montgomery

(10) Patent No.: US 10,030,604 B2
(45) Date of Patent: Jul. 24, 2018

(54) PISTON TOP LAND STRUCTURE

(71) Applicant: Caterpillar Inc., Peoria, IL (US)

(72) Inventor: David Montgomery, Edelstein, IL (US)

(73) Assignee: Caterpillar Inc., Deerfield, IL (US)

( * ) Notice: Subject to any disclaimer, the term of this patent is extended or adjusted under 35 U.S.C. 154(b) by 179 days.

(21) Appl. No.: 15/223,993

(22) Filed: Jul. 29, 2016

(65) Prior Publication Data

US 2018/0030921 A1 Feb. 1, 2018

(51) Int. Cl.

| | |
|---|---|
| ***F02F 3/00*** | (2006.01) |
| ***F02F 3/28*** | (2006.01) |
| ***F02F 1/00*** | (2006.01) |
| ***F01L 3/00*** | (2006.01) |
| ***F02P 15/00*** | (2006.01) |

(52) U.S. Cl.

CPC ..... *F02F 3/28* (2013.01); *F01L 3/00* (2013.01); *F02F 1/004* (2013.01); *F02P 15/001* (2013.01)

(58) Field of Classification Search

CPC .. F02F 3/28; F02F 1/004; F02P 15/001; F01L 3/00

USPC ..... 123/193.6

See application file for complete search history.

(56) References Cited

U.S. PATENT DOCUMENTS

| | | | | |
|---|---|---|---|---|
| 3,508,531 | A * | 4/1970 | Squinto | F16J 1/001 123/193.6 |
| 4,106,463 | A | 8/1978 | Curtis, Jr. et al. | |
| 5,035,210 | A | 7/1991 | Arai et al. | |
| 5,211,101 | A | 5/1993 | Letsch et al. | |
| 2003/0150419 | A1* | 8/2003 | Daragheh | F02F 3/00 123/193.6 |
| 2005/0051128 | A1* | 3/2005 | Kim | F02F 3/28 123/193.6 |
| 2009/0050101 | A1* | 2/2009 | Taylor | F02B 23/0669 123/193.6 |

FOREIGN PATENT DOCUMENTS

| | | | |
|---|---|---|---|
| CA | 2863036 | A1 | 10/2014 |
| JP | 2017203386 | A * | 11/2017 |

* cited by examiner

*Primary Examiner* — Marguerite McMahon
(74) *Attorney, Agent, or Firm* — Miller, Matthias & Hull

(57) ABSTRACT

A piston for a premixed spark-ignited or premixed dual fuel internal combustion engine is disclosed. The piston may be configured to reciprocate along a longitudinal axis of a combustion chamber defined by a cylinder of the engine. The piston may comprise a piston head, a top annular groove configured to receive a top annular ring, and a skirt having a pin bore extending along a pin bore axis that is configured to receive a wrist pin for connecting the piston to a connecting rod. The piston may further comprise a top land formed in the piston head that is chamfered in a direction perpendicular to the pin bore axis such that the top land does not contact an inner wall of the cylinder when the piston rocks about the pin bore axis. The top land may be non-chamfered in a direction parallel to the pin bore axis.

20 Claims, 2 Drawing Sheets

PISTON TOP LAND STRUCTURE

TECHNICAL FIELD

The present disclosure generally relates to internal combustion engines and, more specifically, to pistons for premixed spark-ignited and premixed dual fuel internal combustion engines.

BACKGROUND

Internal combustion engines include one or more pistons connected to a crankshaft by a connecting rod. During the combustion cycles of the engine, the pistons reciprocate along a longitudinal axis within a combustion chamber defined by the walls of a cylinder to drive the rotation of the crankshaft. For example, in a four stroke combustion cycle of a premixed spark-ignited or dual fuel engine, the piston may move from top dead center to bottom dead center to draw in a mixture of fuel and air into the combustion chamber through the intake valve. Following air/fuel intake, the intake valve closes and the piston moves from bottom dead center to top dead center to compress the air/fuel mixture. Subsequent initiation of combustion of the air/fuel mixture with a flame causes the gases to expand which forces the piston to move from top dead center to bottom dead center. A spark is used to initiate combustion in premixed spark-ignited engines, whereas a small amount of diesel fuel ("pilot" fuel) is ignited by compression to initiate combustion in premixed dual fuel engines. Following combustion, an exhaust valve is then opened, and exhaust gases are evacuated from the combustion chamber as the piston moves from bottom dead center to top dead center, allowing the combustion cycle to repeat.

A piston includes a piston head having an upper surface facing the combustion chamber. Around the periphery of the piston head are a plurality of annular ring grooves that receive piston rings which form a seal between the combustion chamber and the crankcase. In addition, a plurality of "lands" extend between and above the annular ring grooves to confine the piston rings in their respective grooves. Above the top piston ring is a "top land" which extends to the upper surface of the piston head. The piston also includes a skirt that includes a pin bore that receives a wrist pin for connecting the piston to the connecting rod. The wrist pin may serve as a bearing on which the piston rocks from side to side as it reciprocates in the combustion chamber.

In prior art designs, the top land of the piston may have a cylindrical shape with a smaller diameter than the engine cylinder, such that the top land is separated from the cylinder walls by a gap which is accessible to air and fuel in the combustion chamber, but is inaccessible to the propagating flame due to heat loss to the closely-spaced metal surfaces. Moreover, as the piston rocks about the pin bore axis (i.e., in a direction concentric to the pin bore axis), the top land may more closely approach or contact the cylinder wall, temporarily creating blocked crevices containing trapped hydrocarbon fuel that cannot be combusted by the propagating flame. As a result of flame inaccessibility to hydrocarbon fuel trapped in such top land crevices, emissions of unburned or partially unburned hydrocarbons may be undesirably increased, contributing to the greenhouse gas footprint of the machine. Hydrocarbon emissions from top land crevices is a problem associated with premixed spark-ignited and premixed dual fuel engines which, unlike diesel engines that ignite fuel through compression, rely on a propagating flame for combustion.

One approach to reduce hydrocarbon emissions from top land crevices, as described in Canadian Patent Application Number CA 2863036 A1, involves the introduction of an annular chamfered edge around the periphery of the top land to provide a conically-shaped top land. The chamfered area of the top land provides clearance for piston rocking and reduces the crevice volume in the direction of rocking, resulting in reduced unburned/partially burned hydrocarbon emissions. However, while effective, the conical/annular chamfered top land geometry unnecessarily augments the crevice volume near regions of the top land where additional clearance for piston rocking is not needed (i.e., directly above the wrist pin bore). By increasing the crevice volume that is difficult for the combustion flame to access, more unburned or partially burned hydrocarbons may be emitted, counteracting at least some of the emission reductions obtained with the annular chamfered edge.

Thus, there is a need for improved piston top land geometries that help reduce unburned or partially burned hydrocarbon emissions from crevices.

SUMMARY

In accordance with one aspect of the present disclosure, a piston for a premixed spark-ignited or a premixed dual fuel internal combustion engine is disclosed. The piston may be configured to reciprocate along a longitudinal axis of a combustion chamber defined by a cylinder of the internal combustion engine. The piston may comprise a piston head that includes an upper surface facing the combustion chamber, and a top annular groove configured to receive a top piston ring. The piston may further comprise a skirt extending from the piston head and including a pin bore extending along a pin bore axis that is configured to receive a wrist pin for connecting the piston to a connecting rod. In addition, the piston may further comprise a top land formed on the piston head that extends between the upper surface and the top annular groove of the piston head. The top land may include an upper annular edge that adjoins the upper surface of the piston head, and a lower annular edge that adjoins the top annular groove. The upper annular edge may have an elliptical shape with a major axis extending parallel to the pin bore axis (when viewed from above the piston head), and a minor axis extending perpendicular to the pin bore axis. The lower annular edge may have a circular shape with a diameter that is substantially equivalent to a length of the major axis of the upper annular edge.

In accordance with another aspect of the present disclosure, a piston for a premixed spark-ignited or a premixed dual fuel internal combustion engine is disclosed. The piston may be configured to reciprocate along a longitudinal axis of a combustion chamber defined by an inner wall of a cylinder of the engine. The piston may comprise a piston head that includes an upper surface facing the combustion chamber, and a top annular groove configured to receive a top piston ring. The piston may further comprise a skirt extending from the piston head and including a pin bore extending along a pin bore axis that is configured to receive a wrist pin for connecting the piston to a connecting rod. The piston may be configured to rock in the cylinder about the pin bore axis. In addition, the piston may further comprise a top land formed on the piston head that extends between the upper surface and the top annular groove of the piston head. The top land may be chamfered in a direction perpendicular to the pin bore axis such that the top land does not contact the inner wall of the cylinder when the piston rocks about the pin bore axis. The top land may be non-chamfered in a direction parallel to the pin bore axis.

In accordance with another aspect of the present disclosure, an internal combustion engine is disclosed. The internal combustion engine may comprise a cylinder having an inner wall defining a combustion chamber, an intake valve configured to permit a mixture of air and fuel to enter the combustion chamber, a combustion initiation device configured to initiate combustion of the mixture of air and fuel in the combustion chamber, and a crankshaft. The internal combustion engine may further comprise a piston connected to the crankshaft through a connecting rod that is configured to reciprocate along a longitudinal axis of the combustion chamber to drive a rotation of the crankshaft. The piston may include a piston head having an upper surface facing the combustion chamber, and a top annular groove receiving a top piston ring. The piston may further include a skirt having a pin bore extending along a pin bore axis that receives a wrist pin that connects the piston to the connecting rod. The piston may be configured to rock within the combustion chamber about the pin bore axis. In addition, the piston may further include a top land formed in the piston head that extends between the upper surface and the top annular groove of the piston head. The top land may include an upper annular edge that adjoins the upper surface of the piston, a lower annular edge that adjoins the top annular groove, and an outer surface extending from the upper annular edge to the lower annular edge. The upper annular edge may have an elliptical shape with a major axis extending parallel to the pin bore axis and a minor axis extending perpendicular to the pin bore axis. The lower annular edge may have a circular shape with a diameter substantially equivalent to a length of the major axis of the upper annular edge such that the outer surface of the top land includes two chamfered surfaces flanking the major axis of the upper annular edge. The two chamfered surfaces may be angled by about 85° to about 89.9° with respect to the upper surface of the piston head.

These and other aspects and features of the present disclosure will be more readily understood when read in conjunction with the accompanying drawings.

DETAILED DESCRIPTION

Figure 2:
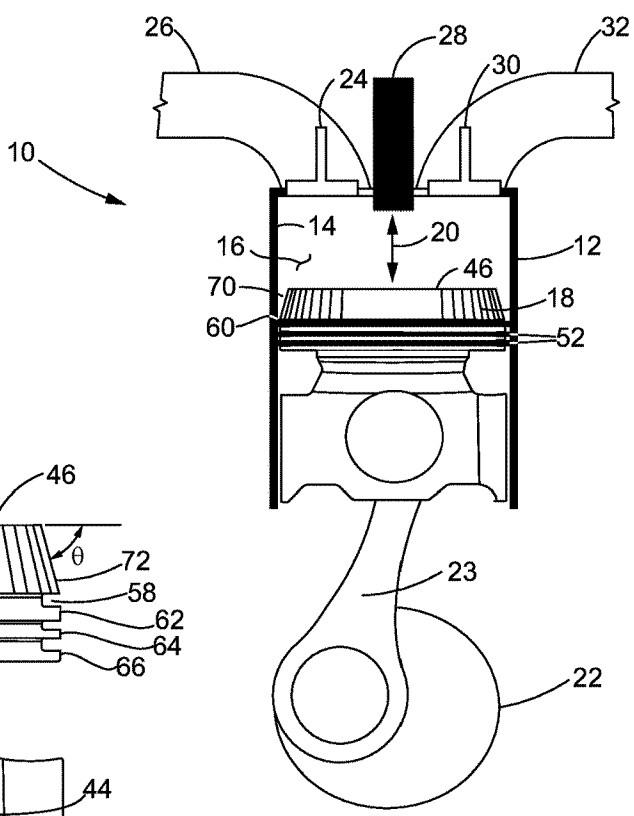
FIG. 2 is a schematic representation of a cylinder and a piston of the internal combustion engine of FIG. 1, constructed in accordance with the present disclosure.
Figure 1:
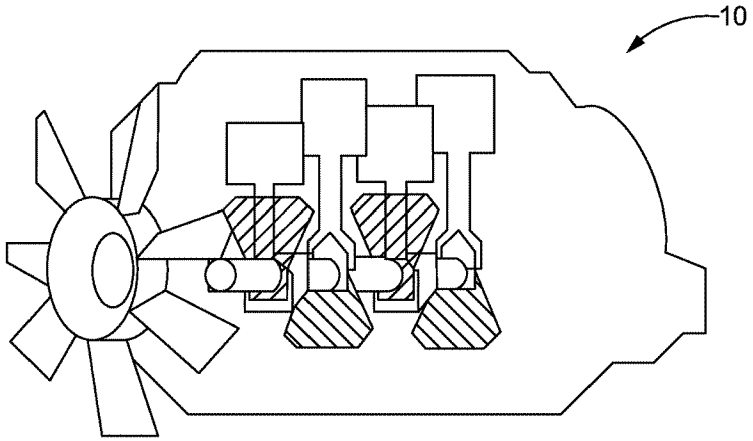
FIG. 1 is a schematic representation of a premixed spark-ignited or a premixed dual fuel internal combustion engine, constructed in accordance with the present disclosure.

Referring now to the drawings, and with specific reference to FIGS. 1-2, an internal combustion engine 10 is shown. The engine 10 may combust fuel to provide power to and/or to drive the movement of a machine such as a hydraulic fracking pump, an electric power generator, a gas compressor, a mining truck, as well as other types of machines. As explained in further detail below, the engine 10 may be an engine that uses a premixed air and fuel charge for combustion, such as a premixed spark-ignited engine or a premixed dual fuel engine. Referring to FIG. 2, the internal combustion engine 10 may include one or more cylinders 12 each having an inner wall/liner 14 defining a combustion chamber 16, and a piston 18 configured to reciprocate along a longitudinal axis 20 of the combustion chamber 16 to drive the rotation of a crankshaft 22 via a connecting rod 23.

In a combustion cycle of the engine 10, an intake valve 24 may be opened and the piston 18 may move down within the cylinder 12 from top dead center to bottom dead center to draw in a "premixed" mixture of air and fuel through an intake manifold 26. The intake valve 24 may then close, and the piston 18 may move up within the cylinder 12 from bottom dead center to top dead center to compress the mixture of air and fuel in the combustion chamber 16. Once compressed, a combustion initiation device 28 may initiate combustion of the air/fuel mixture, and the resulting expansion of the combustion products may force the piston 18 down within the cylinder 12 from top dead center to bottom dead center. If the engine 10 is a premixed spark-ignited engine, the combustion initiation device 28 may be a spark plug. Alternatively, if the engine 10 is a premixed dual fuel engine, the combustion initiation device 28 may be a fuel injector that injects a pilot fuel, such as diesel fuel, that ignites and initiates combustion of a mixture of air and a primary fuel (e.g., natural gas) in the combustion chamber 16. Following combustion, an exhaust valve 30 may open and the piston 18 may move up within the cylinder 12 from bottom dead center to top dead center to push the exhaust gases out of the combustion chamber 16 into an exhaust manifold 32, allowing the combustion cycle to repeat. Although described as a four-stroke engine, it will be understood that the engine 10 may also operate as a two- or six-stroke engine, as will be understood by those with ordinary skill in the art.

Figure 3:
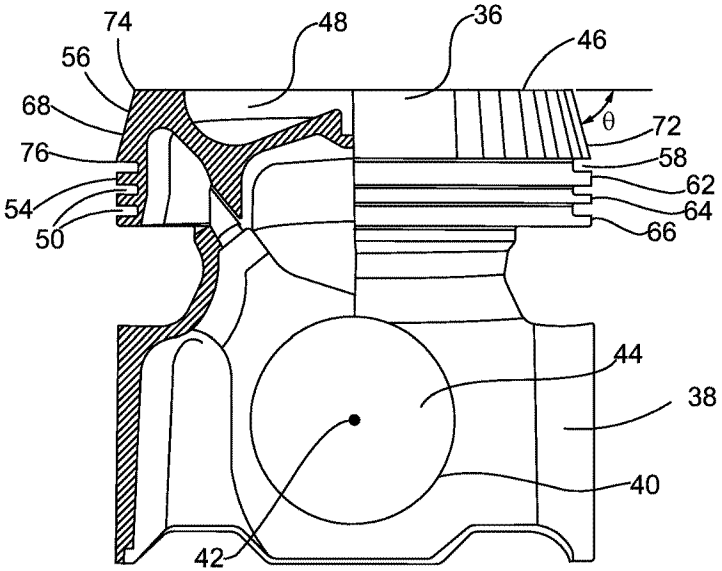
FIG. 3 is a partial cross-sectional view of the piston of FIG. 2 shown in isolation with a connecting rod and piston rings removed for clarity, constructed in accordance with the present disclosure.

With reference to FIGS. 2-3, the structure of the piston 18 will be described in detail. The piston 18 may have a generally cylindrical piston head 36 and a generally cylindrical skirt 38 extending from the piston head 36. The skirt 38 may include a pin bore 40 extending along a pin bore axis 42 that accommodates a wrist pin 44 which pivotally connects the piston 18 to the connecting rod 23. The top of the piston 18 may rock from side to side about the pin bore axis 42 as the piston 18 reciprocates within the cylinder 12 (see FIG. 4 and further details below).

Referring still to FIGS. 2-3, the piston head 36 may include an upper surface 46 that faces and partially defines the combustion chamber 16. Along the upper surface 46 of the piston head 36 may be a piston bowl 48 shaped to control the movement of the air and fuel in the combustion chamber 16 for more efficient combustion. However, in alternative arrangements, the upper surface of the piston 18 may lack a piston bowl. Extending around the periphery of the piston head 36 may be a plurality of annular grooves 50 (see FIG. 3) each sized to accommodate a piston ring 52 (see FIG. 2). The piston rings 52 may sealingly engage the inner wall 14 of the cylinder 12 to wipe excess oil off of the inner wall 14 and/or to prevent combustion gases from leaking past the piston 18 into the crankcase. As one possibility, the piston head 36 may have three annular grooves 50 with three piston rings 52 each received in a respective one of the grooves 50, although other numbers of grooves and piston rings may be provided. Between and above the annular grooves 50 may be lands 54 that serve to confine and support the piston rings 52 in their respective grooves 50. Included among the lands 54 may be a top land 56 positioned above a top annular groove 58 that accommodates a top piston ring 60. Beneath the top land 56 may be a second land 62, a third land 64, and a fourth land 66 in descending order, as shown in FIG. 3. The top land 56 may have an outer surface 68 that faces the inner wall 14 of the cylinder 12 and extends from the top annular groove 58 to the upper surface 46 of the piston head 36. Between the outer surface 68 of the top land 56 and the inner wall 14 of the cylinder 12 may be a crevice 70 or space (see FIG. 2) that is penetrable by air and hydrocarbon fuel in the combustion chamber 16, but is poorly accessible to inaccessible to the combustion flame.

Figure 4:
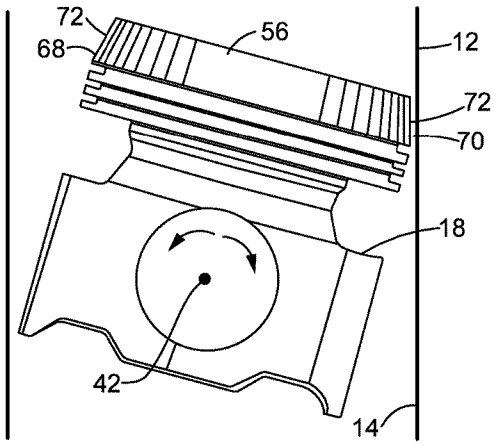
FIG. 4 is a side schematic view of the piston of FIG. 3 with exaggerated rocking in the cylinder about a pin bore axis, constructed in accordance with the present disclosure.

FIG. 4 shows a schematic representation of the piston 18 while rocking side to side about the pin bore axis 42, with the degree of rocking exaggerated for purposes of illustration. Notably, to accommodate piston rocking, the outer surface 68 of the top land 56 may include two chamfered surfaces 72 that flank the pin bore axis 42. As such, the top land 56 may be chamfered in a direction perpendicular to the pin bore axis 42 to provide clearance for the top land 56 as the piston 18 rocks in the combustion chamber 16. More specifically, as shown in FIG. 4, the chamfered surfaces 72 may be angled such that the surfaces 72 alternately extend parallel to or substantially parallel to the inner wall 14 of the cylinder 12 without contacting the inner wall 14 as the piston 18 rocks from side to side. Thus, the chamfered surfaces 72 result in a reduced crevice volume in the direction of piston rocking compared to cylindrical top land geometries of the prior art which contact or more closely approach the cylinder inner wall during rocking to form higher volume crevices containing trapped gases. As a result of the chamfered surfaces 72, engine efficiency may be improved and emissions of unburned or partially burned hydrocarbons may be advantageously reduced.

The two chamfered surfaces 72 may be defined by a chamfer angle θ between the outer surface 68 of the top land 56 and the upper surface 46 of the piston head 36 (see FIG. 3). The chamfer angle θ may be experimentally determined for the type of engine used as the angle that results in a parallel (or substantially parallel) alignment between the chamfered surfaces 72 and the cylinder inner wall 14 when the piston rocks. In one arrangement, the chamfer angle θ may range from about 85° to about 89.9°, or from about 88° to about 89.9°. Described in another way, the chamfered surfaces 72 may be angled by between about 0.1° to about 5° with respect to the inner wall 14 of the cylinder 12 when the piston 18 is not rocking. Alternatively, the chamfered surfaces 72 may be angled by between about 0.1° to about 2° with respect to the cylinder inner wall 14 when the piston 18 is not rocking. However, it will be understood that the chamfer angles may deviate substantially from these ranges depending on the type of engine used.

Figure 5:
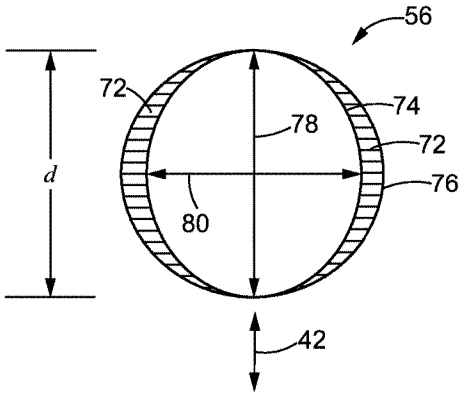
FIG. 5 is a top view of a top land of the piston of FIGS. 2-4 shown in isolation, constructed in accordance with the present disclosure.
Figure 6:
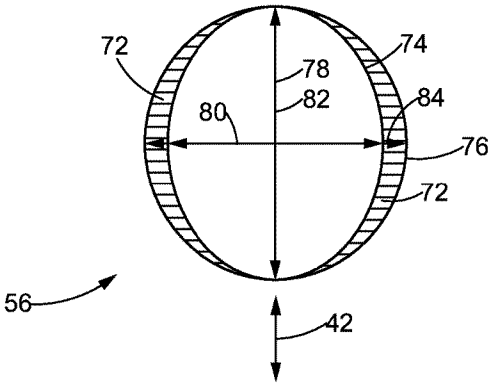
FIG. 6 is a top view of the top land similar to FIG. 5 but with an elliptical lower annular edge, constructed in accordance with the present disclosure.

Turning now to FIG. 5, a top view of the top land 56 is shown. The top land 56 may extend between an upper annular edge 74 and a lower annular edge 76. The upper annular edge 74 may adjoin with and encompass the upper surface 46 of the piston head 36, while the lower annular edge 76 may adjoin the top annular groove 58 (also see FIG. 3). The upper annular edge 74 may have an elliptical shape with a major axis 78 that extends parallel to the pin bore axis 42, and a minor axis 80 that extends perpendicular to the pin bore axis 42. In addition, the lower annular edge 76 may have a circular shape with a diameter (d) that is equivalent to or substantially equivalent to the length of the major axis 78 of the upper annular edge 74. Furthermore, the diameter (d) of the lower annular edge 76 may be longer than the length of the minor axis 80 to create the two chamfered surfaces 72 flanking the major axis 78. In an alternative arrangement of the top land 56 depicted in FIG. 6, the lower annular edge 76 may have an elliptical shape with a major axis 82 having a length equivalent to (or substantially equivalent to) the major axis 78 of the upper annular edge 74, with the major axes 78/82 both being parallel to the pin bore axis 42. In the latter arrangement, a minor axis 84 of the lower annular edge 76 may be longer than the minor axis 80 of the upper annular edge 74 to create the two chamfered surfaces 72 flanking the major axes 78/82.

Thus, the top land 56 may be non-chamfered in a direction parallel to the pin bore axis 42. Unlike conical top land geometries of the prior art which are chamfered around the entire outer surface of the top land, the top land 56 of the piston 18 disclosed herein does not increase the volume of the crevice 70 with chamfered surfaces in the direction that the piston 18 is not rocking. As such, the volume of the crevice 70 is reduced compared with conical top land geometries of the prior art, thus reducing the area that is difficult for the combustion flame to penetrate. Accordingly, even further reductions in hydrocarbon emissions should be achieved with the top land structure disclosed herein compared with conical top land structures of the prior art.

Figure 7:
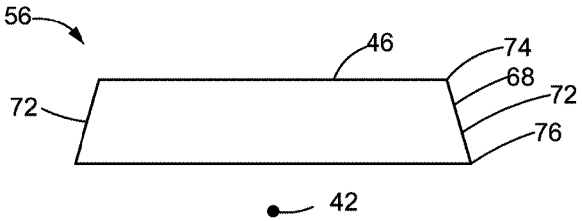
FIG. 7 is a side view of the top land of FIG. 5 as viewed along an axis parallel to the pin bore axis, constructed in accordance with the present disclosure.
Figure 8:
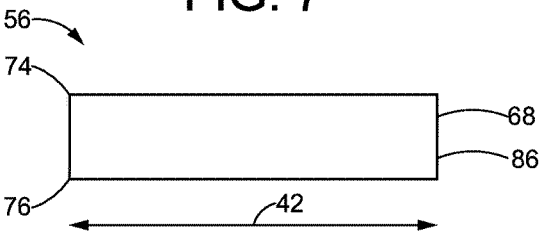
FIG. 8 is a side view of the top land of FIG. 5 as viewed along an axis perpendicular to the pin bore axis, constructed in accordance with the present disclosure.

FIG. 7 illustrates the tapered/chamfered geometry of the top land 56 in the direction perpendicular to the pin bore axis 42, while FIG. 8 illustrates the non-tapered/non-chamfered geometry of the top land 56 in the direction parallel to the pin bore axis 42. As can be seen in FIG. 7, the upper annular edge 74 may be flush with the lower annular edge 76 in the direction parallel to the pin bore axis 42 to provide a non-chamfered outer surface 86 along the outer surface 68 of the top land 56. The top land structure disclosed herein may be formed using a suitable machining tool such as, but not limited to, a non-circular machining lathe.

Industrial Applicability

In general, the teachings of the present disclosure may find applicability in many industries including, but not limited to, industries using internal combustion engines that combust a premixed air and fuel charge, such as premixed spark-ignited and dual fuel engines. More specifically, the teachings of the present disclosure may be applicable to any industry aiming to reduce greenhouse gas emissions from premixed spark-ignited or dual fuel engines.

As is known, a piston may rock about the pin bore axis as it reciprocates within the engine cylinder. The top land structure disclosed herein includes chamfered surfaces in a direction perpendicular to the pin bore axis to provide clearance for piston rocking. The chamfered surfaces reduce the crevice volume in the direction of piston rocking compared to cylindrical top land designs of the prior art. The reduced crevice volume reduces the space containing trapped combustion gases that are inaccessible to the flame, resulting in reduced emissions of unburned/partially burned hydrocarbons compared with cylindrical top land designs of the prior art. The chamfered surfaces of the top land disclosed herein are angled such that the chamfered surfaces alternately extend parallel to the inner wall of the cylinder with a minimal space therebetween as the piston rocks. Moreover, compared to conical top land geometries of the prior art which are chamfered around the entire outer surface of the tap land, the top land geometry disclosed herein lacks chamfered surfaces in the direction that the piston is not rocking (directly above the pin bore axis). Thus, the top land geometry of the present disclosure does not expand the crevice volume along portions of the top land that are not in danger of contacting the cylinder inner wall as the piston rocks about the pin bore axis. The reduction in the overall crevice volume compared to conical top land designs of the prior art reduces the space that may contain hydrocarbon fuel molecules that are inaccessible or poorly accessible to the combustion flame. As a result, engine efficiency should be improved, and emissions of unburned/partially burned hydrocarbons as well as the greenhouse gas footprint of the engine should be even further reduced compared to conical top land designs.

It is expected that the technology disclosed herein may find wide industrial applicability in a wide range of areas such as, but not limited to, transportation, construction, agricultural, mining, power generation, drilling, and fracking applications.

What is claimed is:

1. A piston for a premixed spark-ignited or a premixed dual fuel internal combustion engine, the piston being configured to reciprocate along a longitudinal axis of a combustion chamber defined by a cylinder of the internal combustion engine, comprising:

a piston head including an upper surface facing the combustion chamber, and a top annular groove configured to receive a top piston ring;

a skirt extending from the piston head and including a pin bore configured to receive a wrist pin for connecting the piston to a connecting rod, the pin bore extending along a pin bore axis; and a top land formed on the piston head and extending between the upper surface and the top annular groove of the piston head, the top land including an upper annular edge that adjoins the upper surface of the piston head and a lower annular edge that adjoins the top annular groove, the upper annular edge having an elliptical shape with a major axis extending parallel to the pin bore axis and a minor axis extending perpendicular to the pin bore axis, the lower annular edge having a circular shape with a diameter substantially equivalent to a length of the major axis of the upper annular edge.

2. The piston of claim 1, wherein the diameter of the lower annular edge is greater than a length of the minor axis of the upper annular edge.

3. The piston of claim 2, wherein the top land is chamfered in a direction perpendicular to the pin bore axis.

4. The piston of claim 3, wherein the top land is non-chamfered in a direction parallel to the pin bore axis.

5. The piston of claim 4, wherein the upper annular edge is flush with the lower annular edge in a direction parallel to the pin bore axis.

6. The piston of claim 5, wherein the top land further includes an outer surface extending between the upper annular edge and the lower annular edge, the outer surface being configured to face an inner wall of the cylinder and including two chamfered surfaces flanking the major axis of the upper annular edge.

7. The piston of claim 6, wherein the two chamfered surfaces of the top land are each angled by between about 85° to about 89.9° with respect to the upper surface of the piston head.

8. The piston of claim 7, wherein the two chamfered surfaces of the top land are each angled by between about 88° to about 89.9° with respect to the upper surface of the piston head.

9. A piston for a premixed spark-ignited or a premixed dual fuel internal combustion engine, the piston being configured to reciprocate along a longitudinal axis of a combustion chamber defined by an inner wall of a cylinder of the engine, comprising:

a piston head including an upper surface facing the combustion chamber, and a top annular groove configured to receive a top piston ring;

a skirt extending from the piston head and including a pin bore configured to receive a wrist pin for connecting the piston to a connecting rod, the pin bore extending along a pin bore axis, the piston being configured to rock in the cylinder about the pin bore axis; and a top land formed on the piston head and extending between the upper surface and the top annular groove of the piston head, the top land being chamfered in a direction perpendicular to the pin bore axis such that the top land does not contact the inner wall of the cylinder when the piston rocks about the pin bore axis, the top land being non-chamfered in a direction parallel to the pin bore axis.

10. The piston of claim 9, wherein the top land includes two chamfered surfaces flanking the pin bore axis, and wherein the two chamfered surfaces alternately extend substantially parallel to the inner wall of the cylinder when the piston rocks about the pin bore axis.

11. The piston of claim 10, wherein the two chamfered surfaces of the top land are each angled by between about 85° to about 89.9° with respect to the upper surface of the piston head.

12. The piston of claim 10, wherein the two chamfered surfaces are each angled by between about 88° to about 89.9° with respect to the upper surface of the piston head.

13. The piston of claim 10, wherein the top land further includes an upper annular edge that adjoins the upper surface of the piston head, a lower annular edge that adjoins the top ring groove, and wherein the two chamfered surfaces each extend from the upper annular edge to the lower annular edge.

14. The piston of claim 13, wherein the upper annular edge of the top land has an elliptical shape with a major axis extending parallel to the pin bore axis and a minor axis extending perpendicular to the pin bore axis.

15. The piston of claim 14, wherein the lower annular edge of the top land has a circular shape with a diameter substantially equivalent to a length of the major axis of the upper annular edge.

16. The piston of claim 14, wherein the lower annular edge has an elliptical shape with a major axis extending parallel to the major axis of the upper annular edge and a minor axis extending parallel to the minor axis of the upper annular edge, wherein the major axis of the lower annular edge has a length substantially equivalent to the length of the major axis of the upper annular edge, and wherein the minor axis of the lower annular edge is longer than the minor axis of the upper annular edge.

17. The piston of claim 15, wherein the upper annular edge is flush with the lower annular edge along the major axis of the upper annular edge.

18. An internal combustion engine, comprising:

a cylinder having an inner wall defining a combustion chamber;

an intake valve configured to permit a mixture of air and fuel to enter the combustion chamber;

a combustion initiation device configured to initiate combustion of the mixture of air and fuel in the combustion chamber;

a crankshaft;

a piston connected to the crankshaft through a connecting rod and being configured to reciprocate along a longitudinal axis of the combustion chamber to drive a rotation of the crankshaft, the piston including a piston head with an upper surface facing the combustion chamber and a top annular groove receiving a top piston ring, the piston further including a skirt having a pin bore extending along a pin bore axis and receiving a wrist pin that connects the piston to the connecting rod, the piston being configured to rock within the combustion chamber about the pin bore axis; and a top land formed in the piston head and extending between the upper surface and the top annular groove of the piston head, the top land including an upper annular edge that adjoins the upper surface of the piston, a lower annular edge that adjoins the top annular groove, and an outer surface extending from the upper annular edge and to the lower annular edge, the upper annular edge having an elliptical shape with a major axis extending parallel to the pin bore axis and a minor axis extending perpendicular to the pin bore axis, the lower annular edge having a circular shape with a diameter substantially equivalent to a length of the major axis of the upper annular edge such that the outer surface of the top land includes two chamfered surfaces flanking the major axis of the upper annular edge, the two chamfered surfaces of the top land being angled by about 85° to about 89.9° with respect to the upper surface of the piston head.

19. The internal combustion engine of claim 18, wherein the internal combustion engine is a premixed spark-ignited engine.

20. The internal combustion engine of claim 18, wherein the internal combustion engine is a premixed dual fuel engine.

* * * * *